United States Patent [19]

Osawa et al.

[11] Patent Number: 4,851,313

[45] Date of Patent: Jul. 25, 1989

[54] PHOTOSENSITIVE MEMBER COMPRISING CHARGE GENERATING LAYER AND CHARGE TRANSPORTING LAYER AND PROCESS FOR PREPARING SAME

[75] Inventors: Izumi Osawa, Ikeda; Syuji Iino, Hirakata; Hideo Hotomi, Suita; Mitsutoshi Nakamura, Osaka; Isao Doi, Toyonaka, all of Japan

[73] Assignee: Minolta Camera Kabushiki Kaisha, Osaka, Japan

[21] Appl. No.: 56,953

[22] Filed: Jun. 3, 1987

[30] Foreign Application Priority Data

Jun. 10, 1986 [JP] Japan ..... 61-134034

[51] Int. Cl.[4] ..... G03G 5/14; G03G 5/082

[52] U.S. Cl. ..... 430/58; 430/132; 430/128

[58] Field of Search ..... 430/58, 60, 61, 66, 430/132, 128

[56] References Cited

U.S. PATENT DOCUMENTS

| | | | |
|---|---|---|---|
| 3,956,525 | 5/1976 | Yasuba | 427/41 |
| 4,043,812 | 8/1977 | Stolka et al. | 430/58 |
| 4,349,617 | 9/1982 | Kawashiri et al. | 430/58 X |
| 4,366,208 | 12/1982 | Akai et al. | 428/421 |
| 4,376,688 | 3/1983 | Ceasar et al. | 204/192 |
| 4,416,755 | 11/1983 | Caesar et al. | 204/192 |
| 4,495,262 | 1/1985 | Matsuzaki et al. | 430/58 |
| 4,510,224 | 4/1985 | Yamazaki et al. | 430/57 |
| 4,518,670 | 5/1985 | Matsuzaki et al. | 430/58 |
| 4,522,905 | 6/1985 | Ogawa et al. | 430/60 |
| 4,544,617 | 10/1985 | Mort et al. | 430/58 |
| 4,557,987 | 12/1985 | Shirai et al. | 430/58 |
| 4,559,289 | 12/1985 | Sunagawa et al. | 430/66 |
| 4,579,801 | 4/1986 | Yashiki | 430/60 |
| 4,634,648 | 1/1987 | Jansen et al. | 430/84 |
| 4,686,164 | 8/1987 | Osawa et al. | 430/63 |
| 4,738,912 | 4/1988 | Iino et al. | 430/58 |
| 4,741,982 | 5/1988 | Iino et al. | 430/58 |

FOREIGN PATENT DOCUMENTS

| | | | |
|---|---|---|---|
| 960073 | 12/1974 | Canada | 430/58 |
| 194329 | 12/1987 | European Pat. Off. . | |
| 50-30526 | 3/1975 | Japan . | |
| 59-38753 | 3/1979 | Japan . | |
| 56-60447 | 3/1979 | Japan . | |
| 54-115134 | 9/1979 | Japan . | |
| 51-46130 | 10/1983 | Japan . | |
| 214859 | 2/1984 | Japan . | |
| 136742 | 3/1984 | Japan . | |
| 61-243460 | 7/1984 | Japan . | |
| 55-86169 | 4/1985 | Japan . | |
| 61761 | 8/1985 | Japan . | |
| 63541 | 10/1985 | Japan . | |
| 60-249155 | 12/1985 | Japan . | |
| 61-94056 | 5/1986 | Japan . | |
| 60-125846 | 6/1986 | Japan . | |
| 60-130747 | 5/1987 | Japan . | |
| 59-28161 | 12/1987 | Japan . | |

OTHER PUBLICATIONS

"A C-NMR Investigation of Plasma Polymerized Ethane, Ethylene, and Acetylene", by A. Dilks, S. Kaplan, and A. Vanlaeken, Xerox Webster Research Center, Xerox Square, W-114, Rochester, New York 14644. Journal of Applied Polymer Science, vol. 17, 1973.

*Primary Examiner*—Roland E. Martin

*Attorney, Agent, or Firm*—Burns, Doane, Swecker & Mathis

[57] ABSTRACT

A photosensitive member of the present invention comprises an electrically conductive substrate, a charge generating layer and a charge transporting layer comprising amorphous carbon which contains a chain hydrocarbon and a cyclic hydrocarbon.

The charge transporting layer is formed by using a chain hydrocarbon and a cyclic hydrocarbon such that the flow rate ratio of the former to the latter is preferably 19:1-1:19.

The photosensitive member of this construction is excellent in electrophotographic characteristics inclusive of charge transportability and charging ability.

13 Claims, 3 Drawing Sheets

PHOTOSENSITIVE MEMBER COMPRISING CHARGE GENERATING LAYER AND CHARGE TRANSPORTING LAYER AND PROCESS FOR PREPARING SAME

BACKGROUND OF THE INVENTION

1. Field of the Invention

The present invention relates to a photosensitive member of the function-separated type comprising a hydrogen-containing amorphous silicon layer as a charge transporting layer, and to a process for preparing the photosensitive member.

2. Description of the Prior Art

Remarkable progress has been made in the application of electrophotographic techniques since the invention of the Carlson process. Various materials have also been developed for use in electrophotographic photosensitive members.

Conventional photoconductive materials chiefly include inorganic compounds such as amorphous selenium, selenium-arsenic, selenium-tellurium, zinc oxide, amorphous silicon and the like, and organic compounds such as polyvinylcarbazole, metal phthalocyanine, disazo pigments, tris-azo pigments, perillene pigments, triphenylmethanes, triphenylamines, hydrazones, styryl compounds, pyrazolines, oxazoles, oxadiazoles and the like. The structures of photosensitive members include, for example, those of the single-layer type wherein such a material is used singly, the binder type wherein the material is dispersed in a binder, and the function-separated type comprising a charge generating layer and a charge transporting layer.

However, conventional photoconductive materials have various drawbacks. For example, the above-mentioned inorganic materials except for amorphous silicon (a-Si) are harmful to the human body.

The electrophotographic photosensitive member, when employed in a copying apparatus, must always have stabilized characteristics even if it is subjected to the severe environmental conditions of charging, exposure, developing, image transfer, removal of residual charges and cleaning, whereas the foregoing organic compounds have poor durability and many unstable properties.

In order to eliminate these drawbacks, progress has been made in recent years in the application of a-Si formed by the glow discharge process to electrophotographic photosensitive members as a material with reduced harmfulness and higher durability. Nevertheless, a-Si is hazardous to manufacture since it requires highly ignitable silane gas as its starting material. Moreover, a-Si requires a large quantity of silane gas which is expensive, rendering the resulting photosensitive member exceedingly more costly than conventional photosensitive members. The manufacture of photosensitive members of a-Si involves many disadvantages. For example, a-Si is low in film-forming speed and releases a large amount of explosive undecomposed silane products in the form of particles when forming a film. Such particles, when incorporated into the photosensitive member being produced, gives a seriously adverse influence on the quality of images to be obtained. Further a-Si has a low chargeability due to its original high specific dielectric constant. This necessitates the use of a charger of higher output for charging the a-Si photosensitive member to a predetermined surface potential in the copying apparatus.

On the other hand, it has been proposed in recent years to use plasma-polymerized organic films for photosensitive members.

Plasma-polymerized organic films per se have been well-known for a long time. In Journal of Applied Polymer Science, Vol. 17, pp. 885–892, 1973, for example, M. Shen and A. T. Bell state that a plasma-polymerized organic film can be produced from the gas of any organic compound. The same authors discuss film formation by plasma polymerization in "Plasma Polymerization," published by the American Chemical Society in 1979.

However, the plasma-polymerized organic films prepared by the conventional process have been used only as insulating films. They are thought to be insulating films having a specific resistivity of about $10^{16}$ ohm-cm like usual polyethylene films, or are used as recognized at least as such. The use of the film for electrophotographic photosensitive members is based also on the same concept; the film has found limited use only as an undercoat or overcoat serving solely as a protective layer, adhesion layer, blocking layer or insulating layer.

For example, Unexamined Japanese Patent Publication SHO No. 59-28161 discloses a photosensitive member which comprises a plasma-polymerized high polymer layer of reticular structure formed on a substrate and serving as a blocking-adhesion layer, and an a-Si layer formed on the polymer layer. Unexamined Japanese Patent Publication SHO No. 59-38753 discloses a photosensitive member which comprises a plasma-polymerized film having a thickness of 10 to 100 angstroms and formed over a substrate as a blocking-adhesion layer, and an a-Si layer formed on the film, the plasma-polymerized film being prepared from a gas mixture of oxygen, nitrogen and a hydrocarbon and having a high resistivity of $10^{13}$ to $10^{15}$ ohm-cm. Unexamined Japanese Patent Publication SHO No. 59-136742 discloses a photosensitive member wherein an aluminum substrate is directly coated with a carbon film having a thickness of about 1 to about 5 μm and serving as a protective layer for preventing aluminum atoms from diffusing through an a-Si layer formed over the substrate when the member is exposed to light. Unexamined Japanese Patent Publication SHO No. 60-63541 discloses a photosensitive member wherein a diamond-like carbon film, 200 angstroms to 2μm in thickness, is interposed between an aluminum substrate and an overlying a-Si layer to serve as an adhesion layer to improve the adhesion between the substrate and the a-Si layer. The publication says that the film thickness is preferably up to 2μm in view of the residual charge.

These disclosed inventions are all directed to a so-called undercoat provided between the substrate and the a-Si layer. In fact, these publications mention nothing whatever about charge transporting properties, nor do they offer any solution to the foregoing substantial problems of a-Si.

Furthermore, U.S. Pat. No. 3,956,525, for example, discloses a photosensitive member of the polyvinylcarbazole-selenium type coated with a polymer film having a thickness of 0.1 to 1 μm and formed by glow discharge polymerization as a protective layer. Unexamined Japanese Patent Publication SHO No. 59-214859 discloses a technique for protecting the surface of an a-Si photosensitive member with an approximately 5-μm-thick film formed by plasma-polymerizing an organic hydrocarbon monomer such as styrene or acetylene. Unexamined Japanese Patent Publication SHO No. 60-61761 discloses a photosensitive member having a diamond-like carbon thin film 500 angstroms to 2μm in thickness and serving as a surface protective layer, it being preferred that the film thickness be up to 2μm in view of transmittancy. Unexamined Japanese Patent Publication SHO No. 60-249115 discloses a technique for forming a film of amorphous carbon or hard carbon with a thickness of about 0.05 to about 5 μm for use as a surface protective layer. The publications states that the film adversely affects the activity of the potected photosensitive member when exceeding 5 μm in thickness.

These disclosed inventions are all directed to a so-called overcoat formed over the surface of the photosensitive member. The publications disclose nothing whatever about charge transporting properties, nor do they solve the aforementioned substantial problems of a-Si in any way.

Unexamined Japanese Patent Publication SHO No. 51-46130 discloses an electrophotographic photosensitive member of the polyvinylcarbazole type which has a polymer film 0.001 to 3 μm in thickness and formed on its surface by being subjected to glow discharge polymerization. Nevertheless, the publication is totally mute about charge transporting properties, further failing to solve the foregoing substantial problems of a-Si.

Thus, the conventional plasma-polymerized organic films for use in electrophotographic photosensitive members are used as undercoats or overcoats because of their insulating properties and need not have a carrier transporting function. Accordingly, the films used are limited in thickness to a very small value of up to about 5 μm if largest. Carriers pass through the film owing to a tunnel effect, while if the tunnel effect is not expectable, the film used has such a small thickness that will not pose problems actually as to the occurrence of a residual potential.

With electrophotographic photosensitive members of the function-separated type, the charge transporting layer must have high ability to transport carriers and needs to be at least $10^{-7}$ $cm^2/V/sec$ in carrier mobility. Further to be satisfactorily usable in electrophotographic systems, the charge transporting layer must have excellent charging characteristics and be capable of withstanding a voltage of 10 V/μm. It is also desired the charge transporting layer be up to 6 in specific dielectric constant to lessen the load on the charger.

SUMMARY OF THE INVENTION

In view of the foregoing problems, the main object of the present invention is to provide a photosensitive member which is generally excellent in electrophotographic characteristics and capable of giving satisfactory images, and to provide a process for preparing the same.

Another object of the invention is to provide a photosensitive member which is excellent in charge transportability and in charging characteristics, and to provide a process for preparing the same.

Another object of the invention is to provide a photosensitive member having a charge transporting layer which is highly resistant to corona charging, moisture and weather and excellent in durability, and to provide a process for preparing the same.

These and other objects of the invention can be fulfilled by providing a photosensitive member which comprises a substrate, a charge generating layer and a charge transporting layer comprising amorphous carbon containing chain hydrocarbon and a cyclic hydrocarbon, the amorphous carbon containing 0.1 to 67 atomic % of hydrogen, and by providing a process for preparing the photosensitive member.

DETAILED DESCRIPTION OF THE INVENTION

Figure 1:
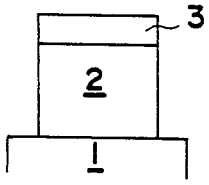
FIGS. 1 to 6 are diagrams showing photosensitive members embodying the invention.

The charge transporting layer of the photosensitive member embodying the present invention is characterized in that the layer comprises an amorphous carbon layer (hereinafter referred to as "a-C layer") which is prepared by a plasma polymerization reaction under a low pressure of an organic gaseous mixture of chain hydrocarbon and cyclic hydrocarbon and which contains hydrogen atoms in an amount of 0.1 to 67 atomic % based on all the constituent atoms of the a-C layer. The charge transporting layer does not exhibit distinct photoconductive properties when exposed to visible light or light in the vicinity of semiconductor laser beams in wavelength, but has suitable ability to transport charges and is excellent in characteristics for use in electrophotographic photosensitive members, e.g. in chargeability, durability and resistance to corona charging, moisture, weather and environmental pollution, and also in transmittancy. The layer therefore affords a high degree of freedom also in providing laminate structures for use as photosensitive members of the function-separated type.

We have conducted research on the application of plasma-polymerized organic layers to photosensitive members and found that the polymerized layer, which is originally thought to be an insulating layer, readily exhibits ability to transport charges with a reduced specific resistivity when prepared from a chain hydrocaron and a cyclic hydrocarbon in the form of a gaseous mixture and adapted to have a proper hydrogen content. Although much still remains to be clarified in detail for the theoretical interpretation of this finding, the result will presumably be attributable to electrons in a relatively unstable state, such as $\pi$-electrons, unpaired electrons, remaining free radicals and the like, which are captured in a charge generating layer and which effectively contribute to charge transportability owing to polarization or a change in stereo structure or the like due to the cyclic structure locally present in a reticular structure formed by the chain hydrocarbon and the cyclic hydrocarbon.

The carbon and hydrogen contents of the a-C layer of the invention can be determined by a usual method of elementary analysis, for example, by organic elementary (CHN) analysis.

According to the invention, the a-C layer is formed using at least two kinds of gaseous materials, i.e. a chain hydrocarbon and a cyclic hydrocarbon. These hydrocarbons need not always be in a gaseous phase at room temperature at atmospheric pressure but can be in a liquid or solid phase insofar as they can be vaporized as by melting, evaporation or sublimation, for example, with heating or in a vacuum. Saturated hydrocarbon or unsaturated hydrocarbons are used as chain hydrocarbons, while alicyclic hydrocarbons and aromatic hydrocarbons are used as cyclic hydrocarbons.

A wide variety of hydrocarbons are usable. Examples of useful saturated hydrocarbons are normal paraffins such as methane, ethane, propane, butane, pentane, hexane, heptane, octane, nonane, decane, undecane, dodecane, tridecane, tetradecane, pentadecane, hexadecane, heptadecane, octadecane, nonadecane, eicosane, heneicosane, docosane, tricosane, tetracosane, pentadosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane, etc.; and the like.

Examples of useful unsaturated hydrocarbons are olefins such as ethylene, propylene, isobutylene, 1-butene, 2-butene, 1-pentene, 2-pentene, 2-methyl-1-butene, 3-methyl-1-butene, 2-methyl-2-butene, 1-hexene, tetramethylethylene, 1-heptene, 1-octene, 1-nonene, 1-decene and the like; diolefins such as allene, methylallene, butadiene, pentadiene, hexadiene, cyclopentadiene and the like; triolefins such as ocimene, alloocimene, myrcene, hexatriene and the like; and acetylene, methylacetylene, 1-butyne, 2-butyne, 1-pentyne, 1-hexyne, 1-heptyne, 1-octyne, 1-nonyne, 1-decyne and the like.

Examples of useful alicyclic hydrocabons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane and the like; cycloolefins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene bisabolene, zingiberene, curcumene, humulene, cadinene sesquibenihene, selinene, caryophyllene, santalene, cedrene, camphorene, phyllocladene, podocarprene, mirene and the like; steroids; etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene and the like.

The flow rate ratio between the chain hydrocarbon and the cyclic hydrocarbon to be used in the invention somewhat varies with the type of apparatus to be used, film-forming conditions, etc. Generally, however, the flow rate of the chain hydrocarbon is preferably 5 to 95%, more preferably 10 to 90%, of the combined flow rate of the two hydrocarbons. Thus, it is preferable that the flow rate of the cyclic hydrocarbon be 95 to 5%, more preferably 90 to 10%, of the combined flow rate. In other words, the flow rate ratio of the chain hydrocarbon to the cyclic hydrocarbon is preferably 19:1–1:19, more preferably 9:1–1:9. When the flow rate of the chain hydrocarbon is lower than 5%, that is, if the flow rate of the cyclic hydrocarbon is higher than 95%, reduced transportability will result, leading to lower sensitivity. Presumably, the reason is that the degree to which the cyclic hydrocarbon contributes to crosslinking then increases to eliminate the original cyclic structure of the cyclic hydrocarbon, so that electrons capable of contributing to transporttability as stated above are not available in a sufficient quantity. Moreover, with the smaller amount of chain hydrocarbon participating in crosslinking, the hydrocarbon mixture is lower in film-forming ability, encountering difficulty in forming a solid-phase film even when subjected to a plasma reaction, with an increased likelihood of giving a particulate or oily reaction product only. If the flow rate of the chain hydrocarbon is higher than 95%, i.e. if the flow rate of the cyclic hydrocarbon is smaller than 5%, reduced transportability and lower sensitivity will similarly result, presumably because a reduced quantity of cyclic structure incorporated in the a-C layer fails to afford a sufficient amount of electrons capable of contributing to transportability as stated above.

The a-C layer of the present invention contains 0.1 to 67 atomic %, preferably 30 to 60 atomic %, of hydrogen atoms based on the combined amount of carbon and hydrogen atoms present. If the amount of hydrogen atoms is less than 0.1 atomic %, reduced transportability will result, failing to give suitable sensitivity, whereas amounts of hydrogen atoms exceeding 67 atomic % entail reduced chargeability and impaired film-forming ability.

The hydrogen content of the a-C layer of the invention is variable in accordance with the film forming apparatus and film forming conditions. The hydrogen content can be decreased, for example, by elevating the substrate temperature, lowering the pressure, reducing the degree of dilution of the starting materials, i.e. the hydrocarbon gases, applying a greater power, decreasing the frequency of the alternating electric field to be set up or increasing the intensity of a d.c. electric field superposed on the alternating electric field.

The a-C layer of the invention is preferably 1.5 to 3.0 eV in optical energy gap Egopt and 2.0 to 6.0 in specific dielectric constant $\epsilon$.

It is thought that a layer of small Egopt (less than 1.5 eV) has a large number of levels in the vicinity of band end, i.e. at the lower end of conduction band or upper end of filled band. Accordingly, it is likely that such an a-C layer is not always satisfactorily serviceable as the charge transporting layer of a photosensitive member because of low carrier mobility and shortened life of carriers. When having a great Egopt (greater than 3.0 eV), the a-C layer is liable to form a barrier with the charge generating material and the charge transporting material which are usually used in electrophotography, with the resulting likelihood that carriers will not be smoothly injected into the a-C layer of great Egopt from the charge generating or transporting material. Consequently, the photosensitive member having the a-C layer will not exhibit satisfactory characteristics.

On the other hand, the specific dielectric constant, if greater than 6.0, leads to impaired chargeability and lower sensitivity. An a-C layer of increased thickness appears useful for remedying these properties but is not desirable from the viewpoint of productivity. Preferably, the $\epsilon$ value should not be smaller than 2.0 since lower values permit the layer to exhibit polyethylenical properties or characteristics and lower chargeability.

It is suitable that the a-C layer serving as the charge transporting layer of the invention be 5 to 50 μm, preferably 7 to 20 μm, in thickness for use in the usual electrophotographic process. Thicknesses smaller than 5 μm result in a lower charge potential, failing to give a sufficient copy image denstiy, whereas thicknesses larger than 50 μm are not desirable in view of productivity. The a-C layer is high in transmittancy, dark resistivity and charge transportability, traps no carriers even when not smaller than 5 μm in thickness as mentioned above and contributes to light decay.

According to the present invention, the gases of starting materials are made into an a-C layer, most preferably, via a plasma which is produced by d.c. low- or high-frequency, microwave or like plasma process. Alternatively, the layer may be formed via ions which are produced by the ionization deposition, ion-beam deposition or like process, or via neutral particles produced by the vacuum evaporation process, sputtering process or the like. These processes may be used in combination. It is essential that the a-C layer be made of an amorphous hydrocarbon produced by the plasma polymerization reaction of at least two kinds of gaseous starting materials, i.e. a chain hydrocarbon and a cyclic hydrocarbon, and having a hydrogen content in the above-specified range.

The a-C layer thus obtained may thereafter be annealed when so required. The a-C layer can be annealed for example, by heating the layer at 50° to 200° C. for 30 minutes to 2 hours in an atmosphere of oxygen gas, ozone gas, nitrogen gas, hydrogen gas, nitrogen oxide gas, water vapor or the like. The a-C layer thus annealed exhibits stabilized electrostatic characteristics over a prolonged priod of time free of deterioration despite lapse of time.

When a charge generating layer and an overcoat layer are to be formed over the a-C layer to fabricate a photosensitive member, the a-C layer may be annealed after the charge generating layer or the overcoat layer has been formed.

The charge generating layer to be incorporated into the photosensitive member of the present invention is not limited specifically in its material. Examples of materials that are usable are inorganic substances such as amorphous selenium, selenium-arsenic, selenium-tellurium, cadmium sulfide, zinc oxide, and amorphous silicon which contains different elements (e.g. hydrogen, boron, carbon, nitrogen, oxygen, fluorine, phosphorus, sulfur, chlorine, bromine, germanium, etc.) for giving altered characteristics, and organic substances such as polyvinylcarbazole, cyanine compounds, metal phthalocyanine compounds, azo compounds, perillene compounds, triarylmethane compounds, triphenylmethane compounds, triphenylamine compounds, hydrazone compounds, styryl compounds, pyrazoline compounds, oxazole compounds, oxazine compounds, oxadiazole compounds, thiazine compounds, xanthene compounds, pyrylium compounds, quinacridone compounds, indigo compounds, polycyclic quinone compounds, disbenzimidazole compounds, indanthrone compounds and squalylium compounds. Other substances are also usable insofar as they are capable of efficiently producing optically excited carriers when exposed to light and efficiently injecting the carriers into the charge transporting layer.

The process for preparing the charge generating layer is not limited specifically. For example, this layer may be formed by the same process as the charge transporting layer (a-C layer) of the invention, electrodeposition in a liquid phase, spraying, dipping or like coating process, or the like. The same process as employed for preparing the charge transporting layer of the invention is desirable because of a reduced equipment cost and savings in labor.

Most optimally, the photosensitive member of the invention is of the function-separated structure comprising a charge generating layer and a charge transporting layer. These layers can be laminated in a suitably selected manner as required.

Figure 2:
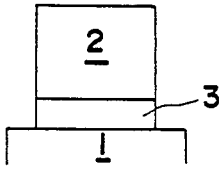
Figure 3:
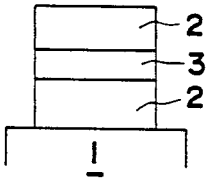

FIG. 1 shows a photosensitive member of one type comprising an electrically conductive substrate 1, a charge transporting layer 2 formed on the substrate and a charge generating layer 3 formed on the layer 2. FIG. 2 shows another type comprising an electrically conductive substrate 1, a charge generating layer 3 on the substrate and a charge transporting layer 2 on the layer 3. FIG. 3 shows another type comprising an electrically conductive substrate 1, and a charge transporting layer 2, a charge generating layer 3 and another charge transporting layer 2 formed over the substrate and arranged one over another.

These photosensitive members are used, for example, by positively charging the surface with a corona charger or the like and exposing the charged surface to an optical image. In the case of FIG. 1. the holes then generated in the charge generating layer 3 travel through the charge transport layer 2 toward the substrate 1. In FIG. 2, the electrons generated in the charge generating layer 3 travel through the charge transporting layer 2 toward the surface of the photosensitive member. In FIG. 3, the holes generated in the charge generating layer 3 travel through the lower charge transporting layer 2 toward the substrate 1, and at the same time, the electrons generated in the charge generating layer 3 travel through the upper transporting layer 2 toward the surface of the member. Consequently, an electrostatic latent image is formed, with satisfactory light decay assured. Conversely, when the surface of the photosensitive member is negatively charged and then exposed, the electron and the hole may be replaced by each other in respect of the above behavior for the interpretation of the travel of carriers. With the structures of FIGS. 2 and 3, the image projecting light passes through the charge transporting layer, which nevertheless has high transmittancy, permitting satisfactory formation of latent images.

Figure 4:
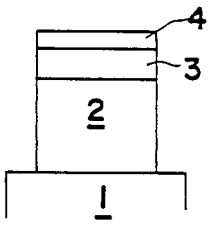

FIG. 4 shows another type comprising an electrically conductive substrate 1, and a charge transporting layer 2, a charge generating layer 3 and a surface protective layer 4 provided over the substrate and arranged one over another. Thus, the illustrated structure corresponds to the structure of FIG. 1 provided with a surface protective layer. Since the outermost surface of the structure of FIG. 1 is provided by a charge generating layer which is not limited specifically in the present invention, it is generally desirable that the surface be covered with a protective layer for assuring durability for use. With the structures of FIGS. 2 and 3, the charge transporting layer embodying the invention and having high durability provides the outermost surface, so that the surface protective layer need not be provided. However, such a photosensitive member can be formed with a surface protective layer as another type so as to be compatible with various other elements within the copying machine, for example, to be free from surface soiling deposition of developer.

Figure 5:
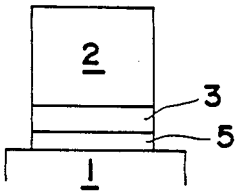

FIG. 5 shows another type comprising an electrically conductive substrate 1, and an intermediate layer 5, a charge generating layer 3 and a charge transporting layer 2 which are formed over the substrate and arranged one over another. Thus, this structure corresponds to the structure of FIG. 2 provided with an intermediate layer. Since a charge generating layer which is not limited specifically in the invention is joined to the substrate in the structure of FIG. 2, it is generally desirable to interpose an intermediate layer therebetween to assure good adhesion and an injection inhibitory effect. With the structures of FIGS. 1 and 3, the charge transporting layer of the invention which is excellent in adhesion and injection inhibitory effect is joined to the substrate, so that no intermediate layer may be provided. However, the photosensitive member of either of these types can be formed with an intermediate layer in order to render the transporting layer to be formed compatible with the preceding fabrication step, such as pretreatment of the conductive substrate. Another type of photosensitive member is then available.

Figure 6:
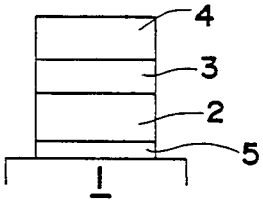

FIG. 6 shows still another type comprising an electrically conductive substrate 1, and an intermediate layer 5, a charge transporting layer 2, a charge generating layer 3 and a surface protective layer 4 which are formed over the substrate and superposed one over another. Thus, this structure corresponds to the structure of FIG. 1 provided with an intermediate layer and a surface protective layer. The intermediate and protective layers are formed for the same reasons as already stated. Thus, the provision of these two layers in the structure of FIGS. 2 or 3 affords another type.

According to the present invention, the intermediate layer and the surface protective layer are not limited specifically in material or fabrication process. Any material or process is suitably selectable provided that the contemplated object can be achieved. The a-C layer of the invention may be used. However, if the material to be used is an insulating material such as one already mentioned, the thickness of the layer needs to be up to 5 $\mu$m to preclude occurrence of residual potential.

To adjust the electrostatic characteristics of the charge transporting a-C layer, this layer may have incorporated therein hetero atoms other than carbon and hydrogen according to the present invention. Examples of such atoms are those of elements in Group III of the Periodic Table and halogen atoms which give improved hole transporting characteristics, and those of elements in Group V of the Periodic Table and alkali metal atoms which afford improved electron transporting characteristics. Also useful are silicon atom, germanium atom, alkaline earth metal atoms and chalcogen atoms. These atoms impart to the layer improved characteristics to transport both positive and negative carriers. At least two kinds of such atoms may be used. Such atoms may be introduced into the charge transporting layer at a specified position only to attain the contemplated purpose, or may have a density distribution. In any case, it is critical that the charge transporting layer be prepared from a chain hydrocarbon and a cyclic hydrocarbon in a flow rate ratio of 1:19–19:1, preferably 1:9–9:1.

The charge transporting layer of the photosensitive member embodying the present invention is produced by so-called plasma polymerization wherein molecules in a vapor phase are subjected to discharge decomposition in a vacuum phase, and the active neutral seeds or charge seeds contained in the resulting atmosphere of plasma are led onto a substrate by diffusion or an electric or magnetic force and accumulated into a solid phase on the substrate through a rebinding reaction.

The a-C layer of the present invention is usable also as an overcoat layer having ability to transport charges. The present a-C layer, even if used merely as an overcoat, of course affords high durability without resulting in an elevated residual potential.

Figure 7:
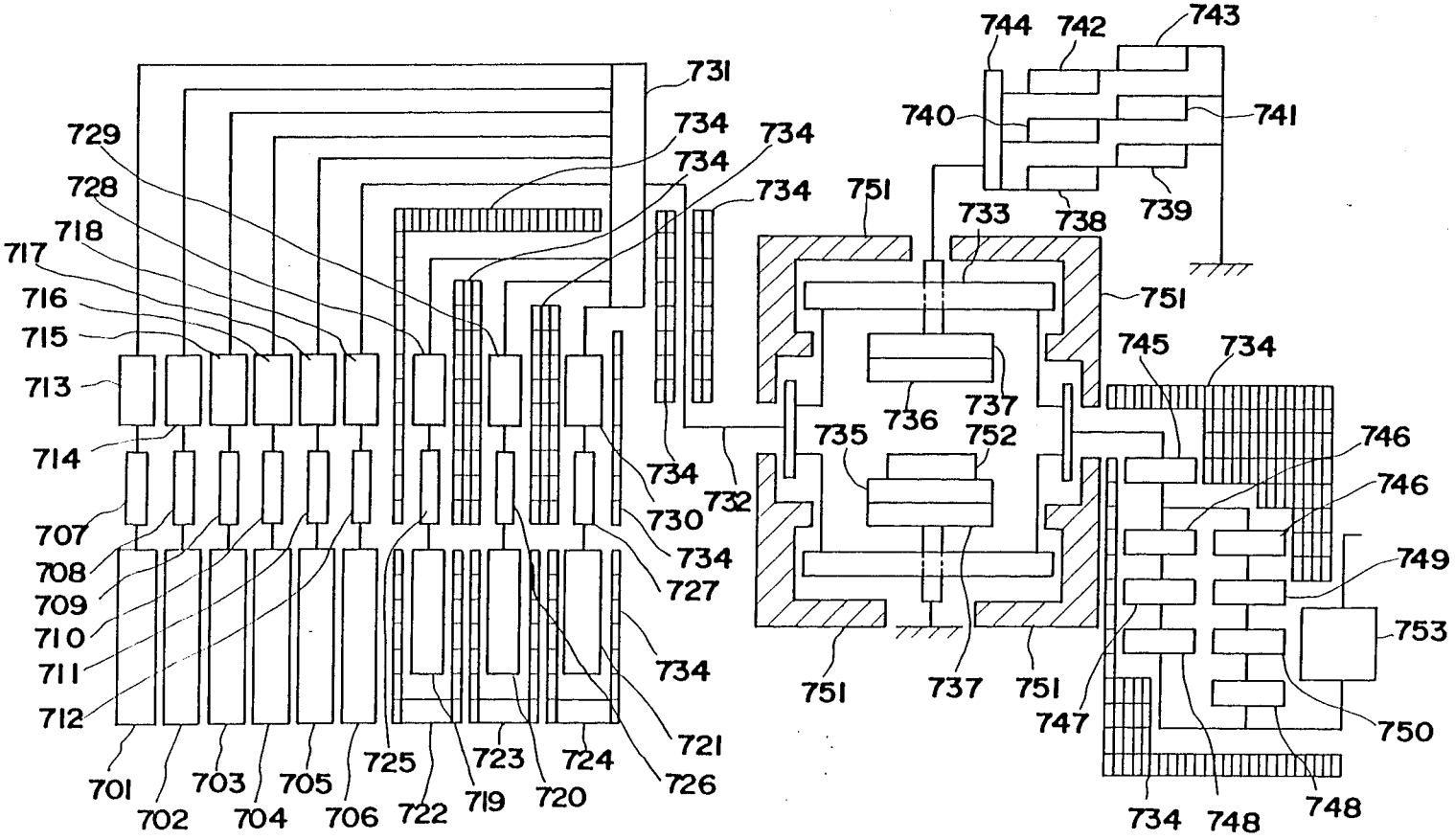
FIGS. 7 and 8 are diagrams showing apparatus for preparing photosensitive members of the invention.

FIG. 7 shows an apparatus for preparing the photosensitive member of the invention. First to sixth tanks 701 to 706 have enclosed therein starting material compounds which are in gas phase at room temperature and a carrier gas and are connected respectively to first to sixth regulator valves 707 to 712 and first to sixth flow controllers 713 to 718. First to third containers 719 to 721 contain starting material compounds which are liquid or solid at room temperature, can be preheated by first to third heaters 722 to 724 for vaporizing the compounds, and are connected to seventh to ninth regulator valves 725 to 727 and seventh to ninth flow controllers 728 to 730, respectively. The gases to be used as selected from among these gases are mixed together by a mixer 731 and fed to a reactor 733 via a main pipe 732. The interconnecting piping can be heated by a pipe heater 734 which is suitably disposed so that the material compound, in a liquid or solid phase at room temperature and vaporize by preheating, will not condense during transport. A grounded electrode 735 and a power application electrode 736 are arranged as opposed to each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740 and to a d.c. power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via another exhaust system selecting valve 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode 735 in the reactor. Although FIG. 7 shows that the substrate 752 is fixed to the grounded electrode 735, the substrate may be attached to the power application electrode 736, or to both the electrodes.

Figure 8:
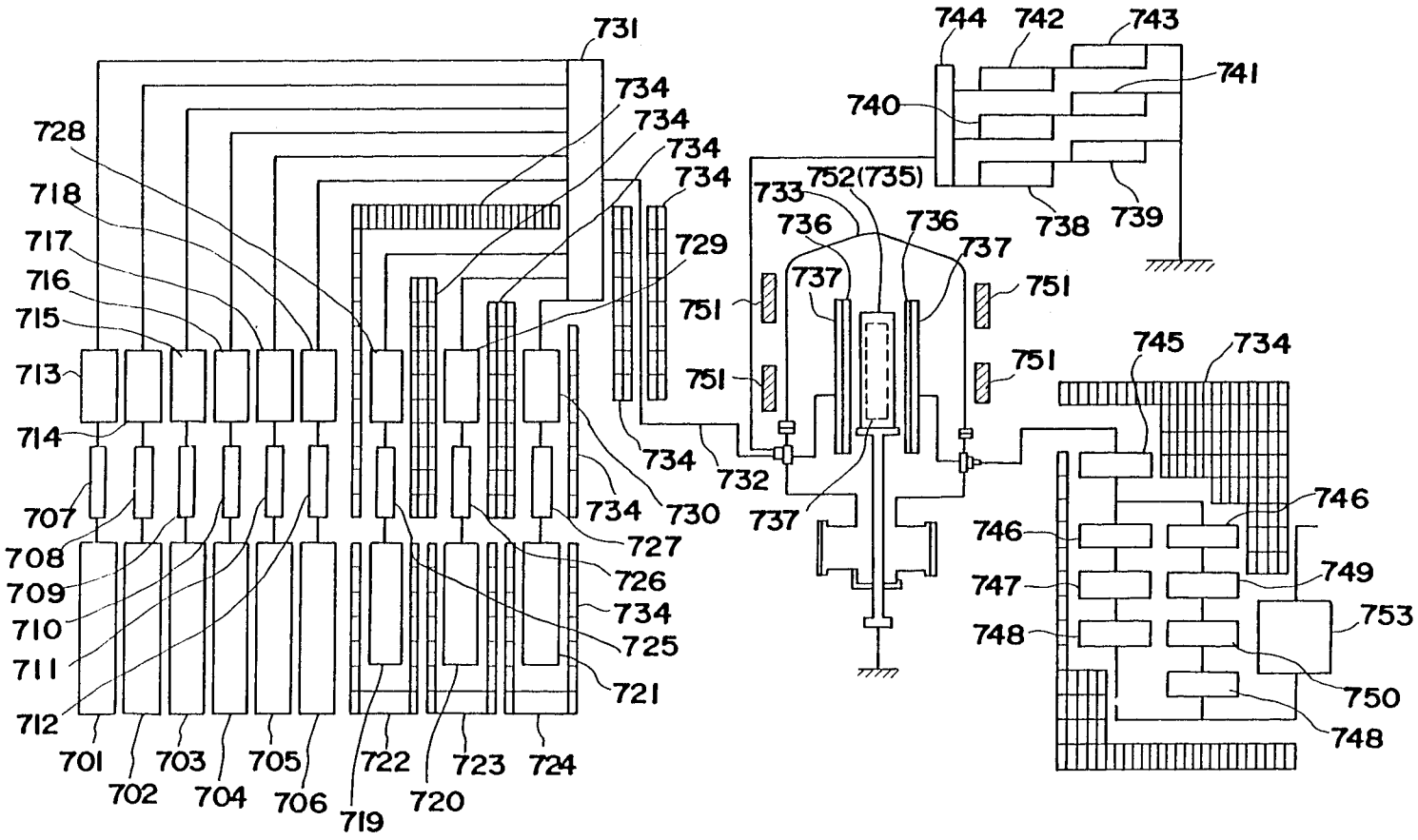

FIG. 8 shows another type of apparatus for preparing the photosensitive member of the invention. This apparatus has the same construction as the apparatus of FIG. 7 with the exception of the interior arrangement of the reactor 733. With reference to FIG. 8, the reactor 733 is internally provided with a hollow cylindrical electrically conductive substrate 752 serving also as the grounded electrode 735 of FIG. 7 and with an electrode heater 737 inside thereof. A power application electrode 736, similarly in the form of a hollow cylinder, is provided around the substrate 752 and surrounded by an electrode heater 737. The conductive substrate 752 is rotatable about its own axis by a drive motor from outside.

The reactor for preparing the photosensitive member is first evacuated by the diffusion pump to a vacuum of about $10^{-4}$ to about $10^{-6}$ torr, whereby the adsorbed gas inside the reactor is removed. The reactor is also checked for the degree of vacuum. At the same time, the electrodes and the substrate fixedly placed on the electrode are heated to a predetermined temperature, for example, of about 20° about 300° C. To obtain a photosensitive member of the desired one of the foregoing structures, an undercoat layer or a charge generating layer may be formed on the substrate before the charge transporting layer is formed when so required. The undercoat or charge generating layer may be formed by the present apparatus or by some other apparatus. Subsequently, material gases, i.e. suitably selected chain hydrocarbon and cyclic hydrocarbon, are fed into the reactor from the first to sixth tanks and the first to third containers (i.e. from those concerned), each at a specified flow rate, using the flow controllers concerned, and the interior of the reactor is maintained in a predetermined vacuum by the pressure control valve. After the combined flow of gases has become stabilized, the high-frequency power source, for example, is selected by the connection selecting switch to apply a high-frequency power of 20 to 500 watts to the power application electrode. The low-frequency power supply, 10 KHz to 1 MHz in frequency, may alternatively be selected. This initiates discharge across the two electrodes, forming a solid layer on the substrate with time. The thickness of the layer is controllable by varying the reaction time, such that the discharge is discontinued upon the thickness reaching the desired value. Consequently, an a-C layer of the invention is obtained which serves as a charge transporting layer.

The a-C layer is characterized in that it is prepared from two kinds of hydrocarbons, i.e. chain hydrocarbon and cyclic hydrocarbon, as material gases by plasma polymerization and contains 0.1 to 67 atomic % of hydrogen atoms based on the combined amount of hydrogen and carbon atoms in the layer.

Next, the regulator valves concerned are closed, and the reactor is thoroughly exhausted. When a photosensitive member of the desired structure has been formed according to the invention, the vacuum within the reactor is vitiated, and the member is removed from the reactor. If a charge generating layer or overcoat layer needs to be further formed to obtain the desired photosensitive structure, the layer is formed using the present apparatus as it is, or using another apparatus to which the product is transferred from the present apparatus after similarly breaking the vacuum, whereby the desired photosensitive member is obtained according to the invention.

When the a-C layer is to be annealed, an annealing gas is introduced into the reactor after completely exhausting the reactor, and the layer is then annealed at a predetermined temperature, for example, of 200° to 500° C. for a specified period of time, for example, for 30 minutes to 2 hours. The reactor is then exhausted, the vacuum is thereafter broken, and the completed photosensitive member of the invention is removed from the reactor. When there is a need to form a charge generating layer or overcoat layer to obtain the desired photosensitive structure, the present apparatus is used as it is after annealing the a-C layer in the same manner as above. Alternatively, the vacuum is broken, the product is transferred from the reactor to another apparatus, and the layer is formed to obtain the desired member. In this case, the annealing treatment may be conducted after the charge generating layer or overcoat layer has been formed.

The present invention will be described with reference to the following examples.

EXAMPLE 1

Using an apparatus for practicing the present invention, a photosensitive member was prepared, the member comprising an electrically conductive substrate, a charge transporting layer and a charge generating layer provided in this order as shown in FIG. 1.

Charge Transporting Layer Forming Step (CTL):

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and a chain hydrocarbon, i.e. ethylene gas, from the second tank 702 into the second flow controller 714, each at an output pressure of 1.0 kg/cm$^2$. At the same time, the seventh regulator valve 725 was opened, and a cyclic hydrocarbon, i.e. styrene gas, vaporized by being heated at a temperature of 25° C. by the first heater 722 was introduced into the seventh flow controller 728 from the first container 719. The dials on the flow controllers were adjusted to supply the hydrogen gas at a flow rate of 40 sccm, the ethylene gas at 30 sccm and the styrene gas at 18 sccm to the reactor 733 through the main pipe 732 via the intermediate mixer 731. The flow rate of the chain hydrocarbon was 62.5% of the combined flow rate of the hydrocarbons. After the flows of the gases stabilized, the internal pressure of the reactor 733 was adjusted to 0.65 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 100-watt power with a frequency of 13.56 MHz was applied to the power application electrode 736 from the high-frequency power source 739 preconnected thereto by the selecting switch 744 to conduct plasma polymerization for 30 minutes,-forming an a-C layer, 10 μm in thickness, as a charge transporting layer on the substrate, whereupon the power supply was discontinued, the regulator valves were closed, and the reactor 733 was fully exhausted.

When subjected to CHN quantitative analysis, the a-C layer thus obtained was found to contain 43 atomic % of hydrogen atoms based on the combined amount of carbon atoms and hydrogen atoms.

Charge Generating Layer Forming Step (CGL):

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controllers were adjusted to supply the hydrogen gas at a flow rate of 210 sccm and the silane gas at 90 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.35 μm.

Characteristics:

When the photosensitive member obtained was used for the usual Carlson process, the member was chargeable to a maximum of over −1000 V. This indicated that the member had satisfactory charging properties. The period of time required for dark decay from −600 V to −550 V was about 30 seconds, showing that the member had satisfactory charge retentivity. When the member was initially chaged to −500 V and thereafter exposed to white light to decay the charge to −150 V, the amount of light required for the light decay was about 3.3 lux-sec. This revealed that the member was satisfactory in photosensitive characteristics. Further the photosensitive member was 2.3 in Egopt and 2.4 in ϵ.

These results indicate that the photosensitive member prepared in the present example according to the invention exhibits outstanding performance. When the member was used in the Carlson process for forming images thereon, followed by image transfer, sharp copy images were obtained.

EXAMPLE 2

Using an apparatus for practicing the present invention, a photosensitive member was prepared, the member comprising an electrically conductive substrate, a charge generating layer and a charge transporting layer provided in this order as shown in FIG. 2.

Process:

The photosensitive member was prepared by exactly the same process as in Example 1 except that CTL step and CGL step in Example 1 were reversed in order.

Characteristics:

When the photosensitive member obtained was used for the usual Carlson process, the member was chargeable to a maximum of over +1000 V. This indicated that the member had satisfactory charging properties. The period of time required for dark decay from +600 V to +550 V was about 40 seconds, showing that the member had satisfactory charge retentivity. When the member was initially charged to +500 V and thereafter exposed to white light to decay the charge to +150 V, the amount of light required for the light decay was about 5.8 lux-sec. This revealed that the member was satisfactory in photosensitive characteristics. Further the photosensitive member was 2.3 in Egopt and 2.4 in ϵ.

These results indicate that the photosensitive member prepared in the present example according to the invention exhibits outstanding performance. When the member was used in the Carlson process for forming images thereon, followed by image transfer, sharp copy images were obtained.

EXAMPLE 3

Using an apparatus for practicing the present invention, a photosensitive member was prepared, the member comprising an electrically conductive substrate, a charge transporting layer and a charge generating layer provided in this order as shown in FIG. 1.

CTL Step:

The glow discharge decomposition apparatus shown in FIG. 8 was used. First the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and a chain hydrocarbon, i.e. propylene gas, from the second tank 702 into the second flow controller 714, each at an output pressure of 1.0 kg/cm$^2$. At the same time, the seventh regulator valve 725 was opened, and a cyclic hydrocarbon, i.e. benzene, vaporized by being heated at a temperature of 60° C. by the first heater 722 was introduced into the seventh flow controller 728 from the first container 719. The dials on the flow controllers were adjusted to supply the hydrogen gas at a flow rate of 40 sccm, the propylene gas at 60 sccm and the benzene gas at 20 sccm to the reactor 733 through the main pipe 732 via the intermediate mixer 731. The flow rate of the chain hydrocarbon was 75% of the combined flow rate of the hydrocarbons. After the flows of the gases stabilized, the internal pressure of the reactor 733 was adjusted to 0.7 torr by the pressure control valve 745. On the other hand, the substrate 752, i.e. a hollow cylindrical aluminum substrate having a diameter of 80 mm and a length of 330 mm, was preheated to 100° C. With the gas flow rates and the pressure in stabilized state, 150-watt power with a frequency of 30 KHz was applied to the power application electrode 736 from the low-frequency power source 741 which was connected to the electrode by the connection selecting switch 744 in advance to conduct a plasma polymerization reaction for 30 minutes, whereby an a-C layer having a thickness of 20 μm and serving as a charge transporting layer was formed on the substrate 752. After the layer was completed, the power supply was discontinued, the regulator valves were closed, and the reactor 733 was thoroughly exhausted.

When subjected to CHN quantitative analysis, the a-C layer thus obtained was found to contain 52% atomic % of hydrogen atoms based on the combined amount of carbon atoms and hydrogen atoms.

CGL (a-Si) Step:

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controller were adjusted to supply the hydrogen gas at a flow rate of 300 sccm and the silane gas at 100 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 150° C. With the gas flow rates and the pressure in stabilized state, 150-watt power with a frequency of 13.56 MHz was applied to the power application electrode 736 from the high-frequency power source 739 preconnected thereto by the connection selecting switch 744 to effect glow discharge for 15 minutes, whereby a charge generating a-Si:H layer was formed with a thickness of 0.35 μm.

Characteristics:

When the photosensitive member obtained was used for the usual Carlson process, the member was chargeable to a maximum of over −1000 V. This indicated that the member had satisfactory charging properties. The period of time required for dark decay from −600 V to −550 V was about 25 seconds, showing that the member had satisfactory charge retentivity. When the member was initially charged to −500 V and thereafter exposed to white light to decay the charge to −150 V, the amount of light required for the light decay was about 2.9 lux-sec. This revealed that the member was satisfactory in photosensitive characteristics. Further the photosensitive member was 2.5 in Egopt and 2.2 in $\epsilon_0$.

These results indicate that the photosensitive member prepared in the present example according to the invention exhibits outstanding performance. When the member was used in the Carlson process for forming images thereon, followed by image transfer, sharp copy images were obtained.

EXAMPLE 4

Using an apparatus for practicing the present invention, a photosensitive member was prepared, the member comprising an electrically conductive substrate, a charge generating layer and a charge transporting layer provided in this order as shown in FIG. 2.

Process:

The photosensitive member was prepared by exactly the same process as in Example 3 except that CTL step and CGL step in Example 3 were reversed in order.

Characteristics:

When the photosensitive member obtained was used for the usual Carlson process, the member was chargeable to a maximum of over +1000 V. This indicated that the member had satisfactory charging properties. The period of time required for dark decay from +600 V to +550 V was about 30 seconds, showing that the member had satisfactory charge retentivity. When the member was initially charged to +500 V and thereafter exposed to white light to decay the charge to +150 V, the amount of light required for the light decay was about 5.4 lux-sec. This revealed that the member was satisfactory in photosensitive characteristics. Further the photosensitive member was 2.5 in Egopt and 2.2 in $\epsilon$.

These results indicate that the photosensitive member prepared in the present example according to the invention exhibits outstanding performance. When the member was used in the Carlson process for forming images thereon, followed by image transfer, sharp copy images were obtained.

EXAMPLE 5

Using an apparatus for practicing the present invention, a photosensitive member was prepared, the member comprising an electrically conductive substrate, a charge transporting layer and a charge generating layer provided in this order as seen in FIG. 1.

CTL Step:

According to the invention, the charge transporting layer was prepared in the same manner as in Example 1 with the exception of altering the flow rates of the chain hydrocarbon, i.e. ethylene gas, and the cyclic hydrocarbon, i.e. styrene gas. More specifically, the flow rates were set to 40 sccm for hydrogen gas, 3 sccm for ethylene gas and 27 sccm for styrene gas. The flow rate of the chain hydrocarbon was 10% of the combined flow rate of the hydrocarbons.

The a-C layer thus obtained had a thickness of 15 μm. CHN quantitative analysis revealed that the layer contained 55 atomic % of hydrogen gas based on the combined amount of carbon and hydrogen atoms.

CGL (a-Si) Step:

The charge generating layer was subsequently formed in the same manner as in Example 1.

Characteristics:

When the photosensitive member obtained was used for the Carlson process, the member was chargeable to a maximum of over −1000 V. This indicated that the member had satisfactory charging properties. The period of time required for dark decay from −600 V to −550 V was about 25 seconds, showing that the member had satisfactory charge retentivity. When the member was initially charged to −500 V and thereafter exposed to white light to decay the charge to −150 V, the amount of light required for the light decay was about 3.7 lux-sec. This revealed that the member was satisfactory in photosensitive characteristics. Further the photosensitive member was 2.2 in Egopt and 2.2 in $\epsilon$.

These results indicate that the photosensitive member prepared in the present example according to the invention exhibits outstanding performance. When the member was used in the Carlson process for forming images thereon, followed by image transfer, sharp copy images were obtained.

EXAMPLE 6

Using an apparatus for practicing the present invention, a photosensitive member was prepared, the member comprising an electrically conductive substrate, a charge generating layer and a charge transporting layer provided in this order as shown in FIG. 2.

Process:

The photosensitive member was prepared by exactly the same process as in Example 5 except that CTL step and CGL step in Example 5 were reversed in order.

Characteristics:

When the photosensitive member obtained was used for the usual Carlson process, the member was chargeable to a maximum of over +1000 V. This indicated that the member had satisfactory charging properties. The period of time required for dark decay from +600 V to +550 V was about 35 seconds, showing that the member had satisfactory charge retentivity. When the member was initially charged to +500 V and thereafter exposed to white light to decay the charge to +150 V, the amount of light required for the light decay was about 6.2 lux-sec. This revealed that the member was satisfactory in photosensitive characteristics. Further the photosensitive member was 2.2 in Egopt and 2.2 in $\epsilon$.

These results indicate that the photosensitive member prepared in the present example according to the invention exhibits outstanding performance. When the member was used in the Carlson process for forming images thereon, followed by image transfer, sharp copy images were obtained.

EXAMPLE 7

Using an apparatus for practicing the present invention, a photosensitive member was prepared, the member comprising an electrically conductive substrate, a charge transporting layer and a charge generating layer provided in this order as shown in FIG. 1.

CTL Step:

According to the invention, the charge transporting layer was prepared in the same manner as in Example 1 with the exception of altering the flow rates of the chain hydrocarbon, i.e. ethylene gas; and the cyclic hydrocarbon, i.e. styrene gas. More specifically, the flow rates were set to 40 sccm for hydrogen gas, 90 sccm for ethylene gas and 10 sccm for styrene gas. The flow rate of the chain hydrocarbon was 90% of the combined flow rate of the hydrocarbons.

The a-C layer thus obtained had a thickness of 12 μm. CHN quantatitive analysis revealed that the layer contained 40 atomic % of hydrogen gas based on the combined amount of carbon and hydrogen atoms.

CGL (a-Si) Step:

The charge generating layer was subsequently formed in the same manner as in Example 1.

Characteristics:

When the photosensitive member obtained was used for the Carlson process, the member was chargeable to a maximum of over −1000 V. This indicated that the member had satisfactory charging properties. The period of time required for dark decay frcm −600 V to −550 V was about 40 seconds, showing that the member had satisfactory charge retentivity. When the member was initially charged to −500 V and thereafter exposed to white light to decay the charge to −150 V, the amount of light required for the light decay was about 2.8 lux-sec. This revealed that the member was satisfactory in photosensitive characteristics. Further the photosensitive member was 2.6 in Egopt and 2.5 in ϵ.

These results indicate that the photosensitive member prepared in the present example according to the invention exhibits outstanding performance. When the member was used in the Carlson process for forming images thereon, followed by image transfer, sharp copy images were obtained.

EXAMPLE 8

Using an apparatus for practicing the present invention, a photosensitive member was prepared, the member comprising an electrically conductive substrate, a charge generating layer and a charge transporting layer provided in this order as shown in FIG. 2.

Process:

The photosensitive member was prepared by exactly the same process as in Example 7 except that CTL step and CGL step in Example 7 were reversed in order.

Characteristics:

When the photosensitive member obtained was used for the usual Carlson process, the member was chargeable to a maximum of over +1000 V. This indicated that the member had satisfactory charging properties. The period of time required for dark decay from +600 V to +550 V was about 40 seconds, showing that the member had satisfactory charge retentivity. When the member was initially charged to +500 V and thereafter exposed to white light to decay the charge to +150 V, the amount of light required for the light decay was about 5.9 lux-sec. This revealed that the member was satisfactory in photosensitive characteristics. Further the photosensitive member was 2.6 in Egopt and 2.5 in ϵ.

These results indicate that the photosensitive member prepared in the present example according to the invention exhibits outstanding performance. When the member was usd in the Carlson process for forming images thereon, followed by image transfer, sharp copy images were obtained.

EXAMPLE 9

Using an apparatus for practicing the present invention, a photosensitive member was prepared, the member comprising an electrically conductive substrate, a charge transporting layer and a charge generating layer provided in this order as shown in FIG. 1.

CTL Step:

According to the invention, the charge transporting layer was prepared in the same manner as in Example 1 with the exception of altering the flow rates of the chain hydrocarbon, i.e. ethylene gas, and the cyclic hydrocarbon, i.e. styrene gas. More specifically, the flow rates were set to 40 sccm for hydrogen gas, 2 sccm for ethylene gas and 38 sccm for styrene gas. The flow rate of the chain hydrocarbon was 5% of the combined flow rate of the hydrocarbons.

The a-C layer thus obtained had a thickness of 21 μm. CHN quantitative analysis revealed that the layer contained 58 atomic % of hydrogen gas based on the combined amount of carbon and hydrogen atoms.

CGL (a-Si) Step:

The charge generating layer was subsequently formed in the same manner as in Example 1.

Characteristics:

When the photosensitive member obtained was used for the Carlson process, the member was chargeable to a maximum of about −1000 V. This indicated that the member had chargeability of about 50 V per micrometer of the thickness of the a-C layer. Although this value was slightly lower than the corresponding values of the members of the foregoing Examples, it, was understood that the chargeability was useful without any problem. The period of time required for dark decay from −600 V to −550 V was about 20 seconds, showing that the member had satisfactory charge retentivity. When the member was initially charged to −500 V and thereafter exposed to white light to decay the charge to −150 V, the amount of light required for the light decay was about 11.5 lux-sec. Although the member was slightly lower in photosensitive properties than those of the preceding Examples, it was understood that the member was usable without any problem. The member was 2.6 in Egopt and 2.0 in ϵ.

These results indicate that the photosensitive member prepared in the present example according to the invention exhibits outstanding performance. When the member was used in the Carlson process with an increased amount of exposure for forming images thereon, followed by image transfer, sharp copy images were obtained.

EXAMPLE 10

Using an apparatus for practicing the present invention, a photosensitive member was prepared, the member comprising an electrically conductive substrate, a charge transporting layer and a charge generating layer provided in this order as shown in FIG. 1.

CTL Step:

According to the invention, the charge transporting layer was prepared in the same manner as in Example 1 with the exception of altering the flow rates of the chain hydrocarbon, i.e. ethylene gas, and the cyclic hydrocarbon, i.e. styrene gas. More specifically, the flow rates were set to 40 sccm for hydrogen gas, 190 sccm for ethylene gas and 10 sccm for styrene gas. The flow rate of the chain hydrocarbon was 95% of the combined flow rate of the hydrocarbons.

The a-C layer thus obtained had a thickness of 15 μm. CHN quantitative analysis revealed that the layer contained 38 atomic % of hydrogen gas based on the combined amount of carbon and hydrogen atoms.

CGL (a-Si) Step:

The charge generating layer was subsequently formed in the same manner as in Example 1.

Characteristics:

When the photosensitive member obtained was used for the Carlson process, the member was chargeable to a maximum of over −1000 V. This indicated that the member had satisfactory charging properties. The period of time required for dark decay from −600 V to −550 V was about 30 seconds, showing that the member had satisfactory charge retentivity. When the member was initially charged to −500 V and thereafter exposed to white light to decay the charge to −150 V, the amount of light required for the light decay was about 8.9 lux-sec. Although the member was slightly lower in photosensitive properties than those of Examples 1 to 8, it was understood that the member was usable without any problem. The member was 2.1 in Egopt and 2.6 in $\epsilon$.

These results indicate that the photosensitive member prepared in the present example according to the invention exhibits outstanding performance. When the member was used in the Carlson process with an increased amount of exposure for forming images thereon, followed by image transfer, sharp copy images were obtained.

EXAMPLE 11

Using an apparatus for practicing the present invention, a photosensitive member was prepared, the member comprising an electrically conductive substrate, a charge transporting layer and a charge generating layer provided in this order as shown in FIG. 1.

CTL Step:

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and a chain hydrocarbon, i.e. n-butane gas, from the second tank 702 into the second flow controller 714, each at an output pressure of 1.0 kg/cm$^2$. At the same time, the seventh regulator valve 725 was opened, and a cyclic hydrocarbon, i.e. cyclohexane, vaporized by being heated at a temperature of 60° C. by the first heater 722 was introduced into the seventh flow controller 728 from the first container 719. The dials on the flow controllers were adjusted to supply the hydrogen gas at a flow rate of 60 sccm, the butane gas at 50 sccm and the cyclohexane gas at 20 sccm to the reactor 733 through the main pipe 732 via the intermediate mixer 731. The flow rate of the chain hydrocarbon was 71.4% of the combined flow rate of the hydrocarbons. After the flows of the gases stabilized, the internal pressure of the reactor 733 was adjusted to 0.8 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 100-watt power with a frequency of 30 KHz was applied to the power application electrode 736 from the low-frequency power source 741 which was connected to the electrode by the connection selecting switch 744 in advance to conduct a plasma polymerization reaction for 30 minutes, whereby an a-C layer having a thickness of 15 $\mu$m and serving as a charge transporting layer was formed on the substrate 752. When the layer was completed, the power supply was discontinued, the regulator valves were closed and the reactor 733 was thoroughly exhausted.

When subjected to CHN quantitative analysis, the a-C layer thus obtained was found to contain 40 atomic % of hydrogen atoms based on the combined amount of carbon atoms and hydrogen atoms.

CGL (a-Si) Step:

Next, the first and sixth regulator valves 707 and 712 were opened to introduce hydrogen gas from the first tank 701 into the first flow controller 713 and silane gas from the sixth tank 706 into the sixth flow controller 718, each at an output pressure of 1.0 kg/cm$^2$. The dials on the flow controller were adjusted to supply the hydrogen gas at a flow rate of 210 sccm and the silane gas at 90 sccm to the reactor 733. After the flows of the gases stabilized, the internal pressure of the reactor 733 was adjusted to 1.0 torr by the pressure control valve 745. On the other hand, the substrate 752 formed with the a-C layer was preheated to 120° C. With the gas flow rates and the pressure in stabilized state, 200-watt power with a frequency of 13.56 MHz was applied to the power application electrode 736 from the high-frequency power source 739 to effect glow discharge for 15 minutes, whereby a charge generating a-Si:H layer was formed with a thickness of 0.35 $\mu$m.

Characteristics:

When the photosensitive member obtained was used for the usual Carlson process, the member was chargeable to a maximum of over −1000 V. This indicated that the member had satisfactory charging properties. The period of time required for dark decay from −600 V to −550 V was about 20 seconds, showing that the member had satisfactory charge retentivity. When the member was initially charged to −500 V and thereafter exposed to white light to decay the charge to −150 V, the amount of light required for the light decay was about 2.8 lux-sec. This revealed that the member was satisfactory in photosensitive characteristics. Further the photosensitive member was 2.8 in Egopt and 3.0 in $\epsilon$.

These results indicate that the photosensitive member prepared in the present example according to the invention exhibits outstanding performance. When the member was used in the Carlson process for forming images thereon, followed by image transfer, sharp copy images were obtained.

EXAMPLE 12

Using an apparatus for practicing the present invention, a photosensitive member was prepared, the member comprising an electrically conductive substrate, a charge transporting layer and a charge generating layer provided in this order as shown in FIG. 1.

CTL Step:

The glow discharge decomposition apparatus shown in FIG. 7 was used. First, the interior of the reactor 733 was evacuated to a high vacuum of about $10^{-6}$ torr, and the first and second regulator valves 707 and 708 were thereafter opened to introduce hydrogen gas from the first tank 701 into the first flow controller 713 and a chain hydrocarbon, i.e. butadiene gas, from the second tank 702 into the second flow controller 714, each at an output pressure of 1.0 kg/cm$^2$. At the same time, the seventh regulator valve 725 was opened, and a cyclic hydrocarbon, i.e. cyclohexane, vaporized by being heated at a temperature of 70° C. by the first heater 722 was introduced into the seventh flow controller 728 from the first container 719. The dials on the flow controllers were adjusted to supply the hydrogen gas at a flow rate of 60 sccm, the butadiene gas at 50 sccm and the cyclohexane gas at 40 sccm to the reactor 733 through the main pipe 732 via the intermediate mixer 731. The flow rate of the chain hydrocarbon was 55.6% of the combined flow rate of the hydrocarbons. After the flows of the gases stabilized, the internal pressure of the reactor 733 was adjusted to 0.8 torr by the pressure control valve 745. On the other hand, the substrate 752, which was an aluminum substrate measuring 50 mm in length, 50 mm in width and 3 mm in thickness, was preheated to 100° C. With the gas flow rates and the pressure in stabilized state, 120-watt power with a frequency of 13.56 MHz was applied to the power application electrode 736 from the high-frequency power source 739 which was preconnected to the electrode by the connection selecting switch 744. At the same time, a bias voltage of −80 V was superposed on the applied power from the d.c. source 743 also preconnected to the electrode. In this way, plasma polymerization was conducted for 30 minutes, forming on the substrate 752 an a-C layer having a thickness of 16 μm and serving as a charge transporting layer. After the layer was completed, the power supply was discontinued, the regulator valves were closed, and the reactor 733 was thoroughly exhausted.

CHN quantitative analysis indicated that the resulting a-C layer contained 36 atomic % of hydrogen atoms based on the combined amount of carbon and hydrogen atoms.

CGL (a-Si) Step:

The substrate having the charge transporting layer formed thereon by CTL step and withdrawn from the reaction was placed into a vacuum evaporation apparatus, in which the layer was coated with $As_2Se_3$ to a thickness of 1 μm by resistance heating.

Characteristics:

When the photosensitive member obtained was used for the usual Carlson process, the member was chargeable to a maximum of over +1000 V. This indicated that the member had satisfactory charging properties. The period of time required for dark decay from +600 V to +550 V was about 25 seconds, showing that the member had satisfactory charge retentivity. When the member was initially charged to +500 V and thereafter exposed to white light to decay the charge to +150 V, the amount of light required for the light decay was about 2.2 lux-sec. This revealed that the member was satisfactory in photosensitive characteristics. Further the photosensitive member was 2.3 in Egopt and 2.4 in ε.

EXAMPLE 13

Using an apparatus for practicing the present invention, a photosensitive member was prepared, the member comprising an electrically conductive substrate, a charge generating layer and a charge transporting layer provided in this order as shown in FIG. 2.

CGL (a-Si) Step:

The glow discharge decomposition apparatus shown in FIG. 7 was used. First, the interior of the reactor 733 was evacuated to a high vacuum of about $10^{-6}$ torr, and the first and sixth regulator valves 707 and 712 were thereafter opened to introduce hydrogen gas from the first tank 701 into the first flow controller 713 and silane gas from the sixth tank 706 into the sixth flow controller 718, each at an output pressure of 1.0 kg/cm$^2$. The dials on the flow controllers were adjusted to supply the hydrogen gas at a flow rate of 210 sccm and the silane gas at 90 sccm to the reactor 733. After the gas flows stabilized, the internal pressure of the reactor 733 was adjusted to 1.0 torr by the pressure control valve 745. On the other hand, the substrate 752 was preheated to 200° C. The substrate was made of aluminum, and was 50 mm in length, 50 mm in width and 3 mm in thickness. With the gas flow rates and the pressure in stabilized state, 200-watt power with a frequency of 13.56 MHz was applied to the power application electrode 736 from the high-frequency power source 739 to cause glow discharge for 15 minutes, forming on the substrate 752 a charge generating a-Si:H layer with a thickness of 0.35 μm.

CTL Step:

Next, the first and second regulator valves 707 708 were opened to introduce hydrogen gas from the first tank 701 into the first flow controller 713 and a chain hydrocarbon, i.e. propane gas, from the second tank 702 into the second flow controller 714, each at an output pressure of 1.0 kg/cm$^2$. At the same time, the seventh regulator valve 725 was opened, and a cyclic hydrocarbon, i.e. cyclohexane, vaporized by being heated at a temperature of 75° C. by the first heater 722 was introduced into the seventh flow controller 728 from the first container 719. The dials on the flow controllers were adjusted to supply the hydrogen gas at a flow rate of 60 sccm, the propane gas at 10 sccm and the cyclohexane gas at 55 sccm to the reactor 733 through the main pipe 732 via the intermediate mixer 731. The flow rate of the chain hydrocarbon was 15.4% of the combined flow rate of the hydrocarbons. After the flows of the gases stabilized, the internal pressure of the reactor 733 was adjusted to 0.6 torr by the pressure control valve 745. On the other hand, the substrate formed with the a-Si:H layer was preheated to 120° C. With the gas flow rates and the pressure in stabilized state, 100-watt power with a frequency of 30 KHz was applied to the power application electrode 736 from the low-frequency power source 741 which was preconnected thereto by the connection selecting switch 744 to conduct plasma polymerization for 30 minutes, whereby an a-C layer having a thickness of 19 μm and serving as a charge transporting layer was formed over the a-Si:H layer on the substrate 752.

When subjected to CHN quantitative analysis, the a-C layer thus obtained was found to contain 40 atomic % of hydrogen atoms based on the combined amount of carbon atoms and hydrogen atoms.

When the photosensitive member obtained was used for the usual Carlson process, the member was chargeable to a maximum of over +1000 V. This indicated that the member had satisfactory charging properties. The period of time required for dark decay from +600 V to +550 V was about 25 seconds, showing that the member had satisfactory charge retentivity. When the member was initially charged to +500 V and thereafter exposed to white light to decay the charge to +150 V, the amount of light required for the light decay was about 3.5 lux-sec. This revealed that the member was satisfactory in photosensitive characteristics. Further the photosensitive member was 2.4 in Egopt and 2.3 in ε.

These results indicate that the photosensitive member prepared in the present example according to the invention exhibits outstanding performance. When the member was used in the Carlson process for forming images thereon, followed by image transfer, sharp copy images were obtained.

COMPARATIVE EXAMPLE 1

Using an apparatus for practicing the invention in a step of process, a photosensitive member was prepared, the member comprising an electrically conductive substrate, a charge transporting layer and a charge generating layer disposed in this order as shown in FIG. 1.

CTL Step:

Aluminum was deposited by vacuum evaporation on the rear surface of polystyrene film usually available commercially to use the coated film as a substitute for the conductive substrate.

CGL Step:

The film was placed in the apparatus shown in FIG. 7 as the substrate 752, and the interior of the reactor 733 was thoroughly evacuated. The first and six regulator valves 707 and 712 were opened to introduce hydrogen gas from the first tank 701 into the first flow controller 713 and silane gas from the sixth tank 706 into the sixth flow controller 718, each at an output pressure of 1.0 $kg/cm^2$. The dials on the flow controllers were adjusted to supply the hydrogen gas at a flow rate of 210 sccm and the silane gas at 90 sccm to the reactor 733. After the gas flows stabilized, the internal pressure of the reactor 733 was adjusted to 1.0 torr by the pressure control valve 745. On the other hand, the substrate 752, i.e. the polystyrene film, was preheated to 50° C. With the gas flow rates and the pressure in stabilized state, 35-watt power with a frequency of 13.56 MHz was applied to the power application electrode 736 from the high-frequency power source 739 preconnected thereto by the connection selecting switch 744 to effect glow discharge for 15 minutes, whereby a charge generating a-Si:H layer was formed with a thickness of 0.35 μm.

Characteristics:

Although having high chargeability, the photosensitive member obtained exhibited no light decay when exposed to light, thus totally failing to function as such a member. The photosensitive member had an $\epsilon$ value of 2.3 which was in the preferred range, but was not lower than 4 in Egopt and was undesirable for use as a photosensitive member.

COMPARATIVE EXAMPLE 2

Using an apparatus for practicing the invention, a photosensitive member was prepared, the member comprising an electrically conductive substrate, a charge transporting layer and a charge generating layer provided in this order as shown in FIG. 1.

CTL Step:

The charge transporting layer was formed in the same manner as in Example 1 with the exception of altering the flow rate of the chain hydrocarbon, ethylene gas, to 60 sccm, using no cyclic hydrocarbon and conducting the film forming operation for 5 hours. Thus, the chain hydrocarbon was the only hydrocarbon used, so that the flow rate ratio thereof was 100%.

The a-C layer obtained in this way had a thickness of 5 μm because of a low film-forming velocity. CHN quantitative analysis revealed that the layer contained 35 atomic % of hydrogen atoms based on the combined amount of carbon and hydrogen atoms.

CGL (a-Si) Step:

The charge generating layer was subsequently formed in the same manner as in Example 1.

When the photosensitive member obtained was used for the usual Carlson process, the member was chargeable to a maximum of about −650 V, thus exhibiting good charging properties in view of the small thickness. The period of time required for dark decay from −600 V to −550 V was about 25 seconds, showing that the member had satisfactory charge retentivity. However, when the member was initially charged to −500 V and thereafter exposed to white light to decay the charge to −150 V, the member exhibited poor decay characteristics in the low-potential region, with the light-decay curve gently sloping down in this region. The quantity of light required for the light decay was about 90 lux-sec. Because of these photosensitive characteristics, the member was found unusable.

The above results indicate that the comparative photosensitive member is not satisfactory in performance. When the member was used in the Carlson process for forming images thereon, followed by image transfer,-fogged copy images only were obtained. This substantiates the superiority of the a-C layer of the invention prepared from a straight-chain hydrocarbon and a cyclic hydrocarbon.

COMPARATIVE EXAMPLE 3

Using an apparatus for practicing the invention, a photosensitive member was prepared, the member comprising an electrically conductive substrate, a charge transporting layer and a charge generating layer provided in this order as shown in FIG. 1.

CTL Step:

The charge transporting layer was formed in the same manner as in Example 1 with the exception of altering the flow rate of the cyclic hydrocarbon, styrene gas, to 30 sccm and using no chain hydrocatbon. Accordingly, the flow rate ratio of chain hydrocarbon was 0%.

The a-C layer thus obtained had a thickness of 22 μm. CHN quantitative analysis revealed that the layer contained 60 atomic % of hydrogen atoms based on the combined amount of carbon and hydrogen atoms.

CGL Step:

The a-C layer was somewhat oily, and it was impossible to form a charge generating layer thereon.

This substantiates the superiority of the a-C layer of the invention prepared from a chain hydrocarbon and a cyclic hydrocarbon.

COMPARATIVE EXAMPLE 4

Using an apparatus for practicing the invention, a photosensitive member was prepared, the member comprising an electrically conductive substrate, a charge transporting layer and a charge generating layer provided in this order as seen in FIG. 1.

CTL Step:

The charge transporting layer was formed in the same manner as in Example 1 with the exception of using a different cyclic hydrocarbon, i.e. cyclohexane, in place of styrene at a gas flow rate of 25 sccm and using no chain hydrocarbon. Accordingly, the flow rate ratio of chain hydrocarbon was 0%.

The a-C layer thus obtained had a thickness of 17 μm. CHN quantitative analysis revealed that the layer contained 52 atomic % of hydrogen atoms based on the combined amount of carbon and hydrogen atoms.

CGL Step:

The a-C layer was oily, and it was impossible to form any charge generating layer thereon.

This substantiates the superiority of the a-C layer of the invention prepared from a chain hydrocarbon and a cyclic hydrocarbon.

What is claimed is:

1. A photosensitive member comprising:
an electrically conductive substrate;
a charge generating layer; and
a charge transporting layer comprising: an amorphous carbon containing hydrogen in an amount of about 0.1 to about 67 atomic % polymer, said amorphous carbon containing hydrogen polymer produced with plasma polymerization by using a chain hydrocarbon and a cyclic hydrocarbon as a starting material, the ratio of said chain hydrocarbon to said cyclic hydrocarbon being from about 19:1 to about 1:19, said amorphous carbon containing hydrogen polymer having an optical energy band gap of from about 1.5 to about 3.0 eV and a specific dielectric constant of from about 2.0 to about 6.0, and said charge transporting layer having a thickness of from about 5 to about 50 microns.

2. A photosensitive member comprising:
an electrically conductive substrate;
a charge generating layer; and
a charge transporting layer comprising: an amorphous carbon containing hydrogen in an amout of about 0.1 to about 67 atomic % polymer, said amorphous carbon containing hydrogen polymer produced with plasma polymerization by using as a starting material a chain hydrocarbon selected from the group consisting of ethylene, butadiene and propylene and a cyclic hydrocarbon selected from the group consisting of styrene, benzene and cyclohexane, the ratio of said chain hydrocarbon to said cyclic hydrocarbon being from about 19:1 to about 1:19, said amorphous carbon containing hydrogen polymer having an optical energy band gap of from about 1.5 to about 3.0 eV and a specific dielectric constant of from about 2.0 to about 6.0, and said charge transporting layer having a thickness of from about 5 to about 50 microns.

3. A process for preparing a photosensitive member which comprises an electrically conductive substrate, a charge generating layer and a charge transporting layer comprising an amorphous carbon containing hydrogen in an amount of about 0.1 to about 67 atomic % polymer said process comprising:
the first step of introducing gaseous materials into a reaction chamber, said materials including a chain hydrocarbon and a cyclic hydrocarbon, the flow rate ratio of said chain hydrocarbon to said cyclic hydrocarbon being from about 19:1 to about 1:19;
the second step of heating the substrate to a predetermined temperature; and
the third step of causing plasma discharge in said reactor chamber in which said gaseous materials introduced are heated by the second step while applying an electric power from a power source to form said charge transporting layer on the substrate, said charge transporting layer having an optical energy band gap of from about 1.5 to about 3.0 eV, a specific dielectric constant of from about 2.0 to about 6.0, and a thickness of from about 5 to about 50 microns.

4. A process as claimed in claim 3 wherein the flow rate ratio of said chain hydrocarbon to said cyclic hydrocarbon is preferably about 9:1 to about 1:1.

5. A process for preparing a photosensitive member which comprises an electrically conductive substrate, a charge generating layer and a charge transporting layer comprising an amorphous carbon containing hydrogen in an amount of about 0.1 to about 67 atomic % polymer, said process comprising:
the first step of producing a vacuum in a reactor chamber;
the second step of heating the substrate to a temperature of about 20° C. to about 300° C.;
the third step of introducing gaseous materials into said evacuated reactor chamber, said materials comprising a chain hydrocarbon and a cyclic hydrocarbon, the flow rate ratio of said chain hydrocarbon to said cyclic hydrocarbon being from about 19:1 to about 1:19;
the fourth step of causing plasma discharge in said reactor chamber in which said gaseous materials are introduced while applying an electric power of about 20 to about 500 watts from a power source to form said charge transporting layer on the substrate, said charge transporting layer having an optical energy band gap of from about 1.5 to about 3.0 eV, a specific dielectric constant of from about 2.0 to about 6.0, and a thickness of from about 5 to about 50 microns.

6. A process as claimed in claim 5 wherein said chain hydrocarbon is selected from the group consisting of ethylene, butadiene and propylene.

7. A process as claimed in claim 6 wherein said cyclic hydrocarbon is selected from the group consisting of styrene, benzene and cyclohexane.

8. A photosensitive member produced by a process as defined by claim 3.

9. A photosensitive member produced by a process as defined by claim 5.

10. A photosensitive member as claimed in claim 9, wherein said chain hydrocarbon is selected from the group consisting of ethylene, butadiene and propylene.

11. A photosensitive member as claimed in claim 9, wherein said cyclic hydrocarbon is selected from the group consisting of styrene, benzene and cyclohexane.

12. A photosensitive member as claimed in claim 1, wherein said ratio of said chain hydrocarbon to said cyclic hydrocarbon is preferably from about 9:1 to about 1:9.

13. A photosensitive member as claimed in claim 2, wherein said ratio of said chain hydrocarbon to said cyclic hydrocarbon is preferably from about 9:1 to about 1:9.

* * * * *